US006917005B2

(12) United States Patent
Sasaki

(10) Patent No.: US 6,917,005 B2
(45) Date of Patent: Jul. 12, 2005

(54) KEY TOP AND KEY TOP LIGHTING DEVICE IN AN ELECTRONIC APPARATUS

(75) Inventor: Fumitoshi Sasaki, Tama (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 10/386,755

(22) Filed: Mar. 12, 2003

(65) Prior Publication Data

US 2003/0217911 A1 Nov. 27, 2003

(30) Foreign Application Priority Data

May 24, 2002 (JP) ..... 2002-151060
Nov. 28, 2002 (JP) ..... 2002-346055

(51) Int. Cl.[7] ..... H01H 9/00
(52) U.S. Cl. ..... 200/314; 200/310; 400/479; 345/168
(58) Field of Search ..... 200/314, 313, 200/317, 310; 400/479, 480; 345/168, 170

(56) References Cited

U.S. PATENT DOCUMENTS 4,250,242 A * 2/1981 Doering ..... 430/141
5,507,661 A * 4/1996 Honda et al. ..... 439/347
6,036,326 A * 3/2000 Yoshikawa et al. ..... 362/23
6,196,738 B1 * 3/2001 Shimizu et al. ..... 400/490

FOREIGN PATENT DOCUMENTS

JP 722425 4/1995
JP 1092258 4/1998

OTHER PUBLICATIONS

Patent Abstracts of Japan 10092258 A, Apr. 1998.

* cited by examiner

*Primary Examiner*—K. Richard Lee
(74) *Attorney, Agent, or Firm*—Ladas & Parry

(57) ABSTRACT

A key top, a key top lighting device and an electronic apparatus with improved operability for use in the dark is provided wherein the key top can be illuminated at a low power consumption rate and without disturbing the people nearby. Specifically, a transparent fluorescent ink that emits fluorescent light upon being irradiated by black light having a wavelength within a range of 300 nm to 450 nm is printed on the key top, and a black light lamp irradiates the black light on this key top, so that the operability of the key top can be improved when used in the dark.

16 Claims, 13 Drawing Sheets

KEY TOP AND KEY TOP LIGHTING DEVICE IN AN ELECTRONIC APPARATUS

BACKGROUND OF THE INVENTION

1. Field of the Invention

The present invention relates to a key top, a key top lighting device, and an electronic apparatus with improved operability for use in the dark.

2. Description of the Related Art

In general, portable electronic apparatuses such as a laptop type personal computer (referred to as laptop PC hereinafter) are carried around to be used in various places. Thus, on some occasions, these types of portable electronic apparatuses are used in dark places. For example, the portable electronic apparatus may be used inside an aircraft during lights-out time, or the electronic apparatus may be used to control an OHP (overhead projector) during a conference and the like.

In such cases, the keyboard used for operating the electronic apparatus needs to be lit. However, when the keyboard is brightly lit during lights-out time in an aircraft, this light may disturb other passengers on board who are sleeping. Also, since the OHP (overhead projector) is used in a dark room in order to realize a clear projection, a bright light illuminating the keyboard may degrade the projection of the OHP.

In response to the above-mentioned problems, a switch having a configuration in which the key top itself lights up is provided (e.g. see Japanese Laid-Open Patent Application No. 10-92258). This type of switch is often used in the push buttons of cell phones and the like. Also, in this type of switch, a transparent portion through which light penetrates is provided at the key top and a light emitting element such as a light bulb or a light emitting diode facing opposite to the transparent portion is provided as well.

Thus, the light emitting elements are lit when the key tops are being operated so that the portable electronic apparatus can be used in the dark. Also, the light from the light emitting element illuminates only the key top and does not go very far beyond the periphery of the key top so that no one will be disturbed by this light.

However, in the above-described key top lighting device, basically, one light emitting element is needed for each key top. Although it is possible to light a plurality of key tops using one light emitting element, the maximum number of key tops that can be lit by one light emitting element is around four key tops. Thus, in an electronic apparatus such as the lap top PC where over 100 key tops are implemented, a large number of light emitting elements will be needed, thereby significantly raising manufacturing costs. Also, since the light emitting elements require electrical power, there will be an increase in the electric power consumption, thereby speeding up the battery energy consumption of the portable electronic apparatus.

SUMMARY OF THE INVENTION

Accordingly, it is an object of the present invention to provide a key top, a key top lighting device, and an electronic apparatus, capable of illuminating the key top at a low energy consumption rate and without disturbing the people nearby.

Specifically, the key top according to the present invention includes:

a key top body; and a fluorescent material, arranged on the key top, that emits light upon being irradiated by black light.

Further, the fluorescent material can be selectively arranged on the key top body.

Also, a non-fluorescent ink can be arranged on the key top body along with the fluorescent material.

Additionally, the fluorescent material can be laminated on top of the non-fluorescent ink.

Further, the fluorescent material may fluoresce upon being irradiated by light having a wavelength within a range of 300 nm to 450 nm.

The key top lighting device according to the present invention includes:

a black light lamp that irradiates black light; and a key top that fluoresces upon being irradiated by the black light from the black light lamp.

Further, the black light lamp may include:

a light emitting element; and a filter member that cuts off light irradiated from the light emitting element that has a wavelength below 300 nm or above 450 nm; wherein the filter member may be intermittently arranged at this light emitting element.

Also, the electric power level supplied to the black light lamp may be changed with respect to time.

The electronic apparatus according to the present invention includes:

a key top lighting device including a black light lamp that irradiates black light, and a key top made of a key top body and a fluorescent material, arranged on the key top body, that emits light upon being irradiated by black light;

a main body; and a lid structure that can be opened and closed to reveal and cover the main body; wherein a key board implementing a plurality of the key tops is arranged at the main body; and the black light lamp is arranged at the lid structure.

DETAILED DESCRIPTION OF THE PREFERRED EMBODIMENTS

In the following, principles and embodiments of the present invention will be described with reference to the accompanying drawings.

Figure 1:
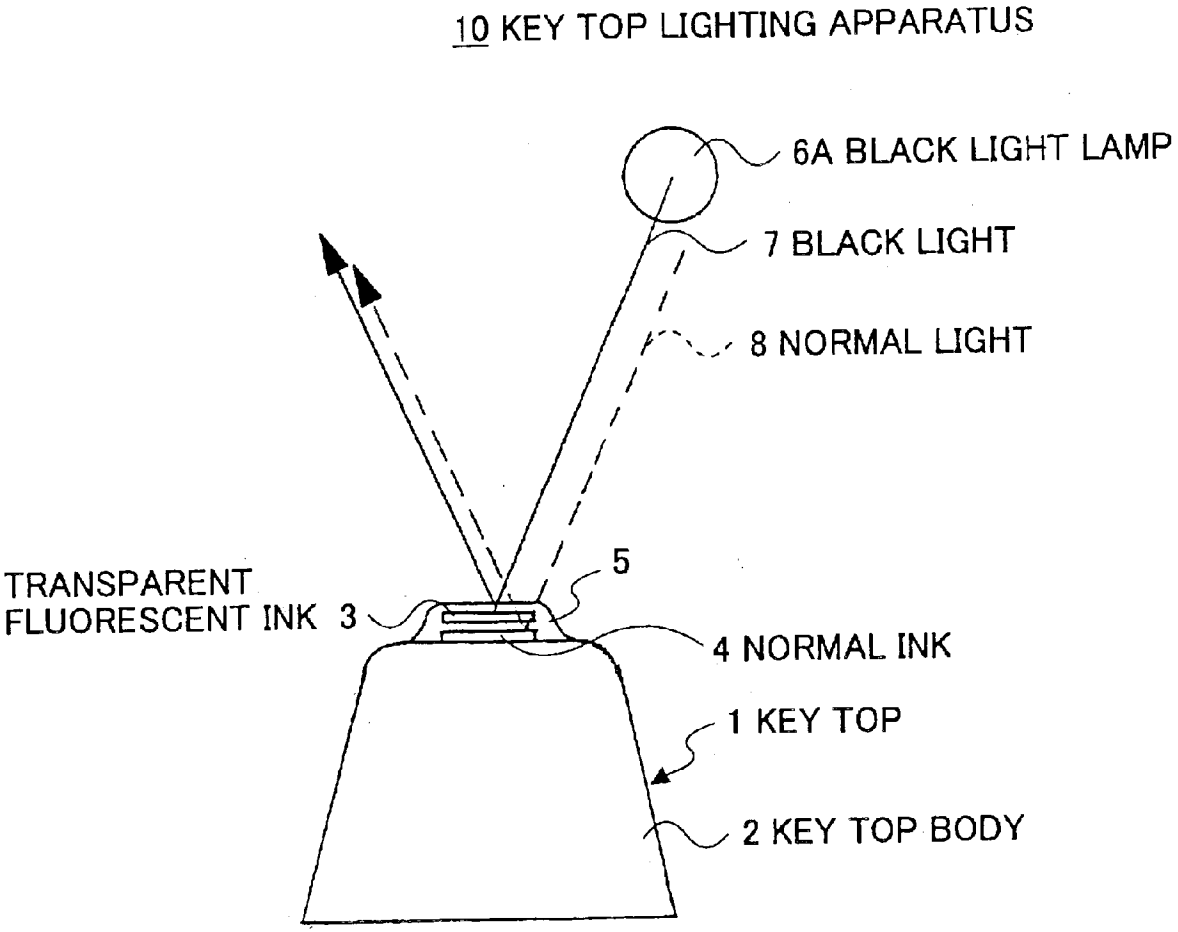
FIG. 1 is a diagram of a key top and a key top lighting device according to an embodiment of the present invention.

FIG. 1 shows a key top 1 and a key top lighting device 10 according to an embodiment of the present invention. The key top lighting device is essentially composed of a key top 1 and a black light lamp 6A.

Figure 2:
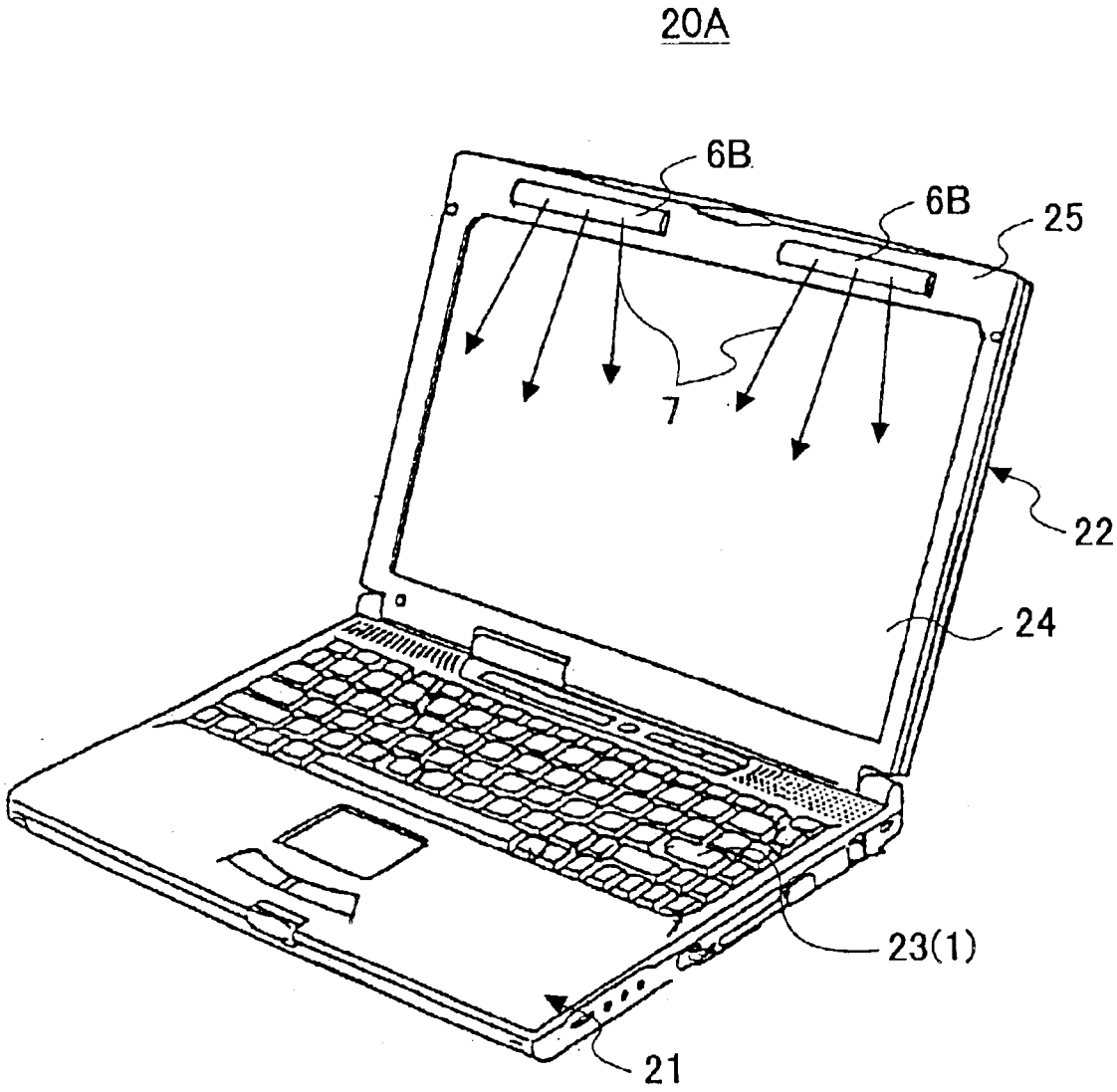
FIG. 2 is a diagram of a portable terminal apparatus that corresponds to an electronic apparatus according to a first embodiment of the present invention (with the lid structure in an opened state)

The key top 1 is a resin molded article and may make up a key board 23 shown in FIG. 2, for example. The key top 1 is made of a key top body 2, transparent fluorescent ink 3, normal ink 4, and overcoat ink 5, etc. The normal ink 4 is printed directly onto the key top 1, and the transparent fluorescent ink 3 is printed on top of the normal ink 4. Further, the overcoat ink 5 is printed onto the key top 1, covering each of the normal ink 4 and the transparent fluorescent ink 3 so as to protect each of these inks. This over coat ink 5 is made of transparent resin.

The transparent fluorescent ink 3 includes fluorescent material that emits light upon being irradiated by light having a specific wavelength discharged from the black light lamp 6A. This transparent fluorescent ink 3 is white or light yellow under sunlight or light illuminated from lamps (referred to as 'normal light' hereinafter).

Also, this transparent fluorescent ink 3 is semi-transparent. Thus, even when this transparent fluorescent ink 3 is layered on top of the normal ink 4, the normal ink 4 can be recognized under the transparent fluorescent ink 3.

The normal ink 4 is ink normally used in printing characters, symbols, figures, etc. on the surface of the key top and is composed of resin with pigment added thereto. Thus, the normal ink 4 does not emit light (fluoresce) even when irradiated by light of a specific wavelength from the black light lamp 6A.

On the other hand, the transparent fluorescent ink 3 used in the present embodiment contains fluorescent material that emits fluorescent light upon being irradiated by light with a wavelength within a range of 300 nm to 450 nm (this light being referred to as 'black light' hereinafter). In turn, the black light lamp 6A is arranged to be capable of emitting black light of a light wavelength between 300 nm and 450 nm. Specifically, the black light lamp 6A is a cold cathode fluorescent lamp having a filter that filters out light other than that with a wavelength in the range of 300 nm to 450 nm.

The light having a wavelength between 300 nm and 450 nm (black light 7) is a long-wave ultraviolet light. Therefore, the black light 7 is not visible to the human eye and irradiation by this light does not produce illumination effects.

The transparent fluorescent ink 3 and the normal ink 4 do not cover the entire key top body 2; rather, they are selectively printed on the top surface of this key top body 2. In this way, a contrast can be made between the portions on which the fluorescent material (transparent fluorescent ink 3) is applied and the portions without this fluorescent material. Thus, an arbitrary cognitive mark can be formed on the key top 2. Herein a cognitive mark refers to a character, a symbol, a figure, etc.

In the above embodiment of the present invention, the black light lamp 6A irradiates the black light 7 on the key top 1 so that the fluorescent material applied thereon emits light. In this way, the key top 1 can be recognized, and in turn, the key top 1 can be operated even in the dark.

The above-described key top lighting device 10 may be implemented in a portable terminal apparatus 20A as shown in FIG. 2. Since the black light 7 irradiated from the black light lamp 6A is a long-wave ultraviolet light, this black light 7 does not light up the surrounding areas. Therefore, the black light 7 does not disturb sleeping passengers on board even when this black light 7 from a black light lamp 6B is irradiated onto a key board 23. of the portable terminal apparatus 20A. Further, in the present embodiment, the key top 1 is merely composed of the key top body 2 and the fluorescent material (more precisely, the transparent fluorescent ink 3 containing the fluorescent material) printed onto this key top body 2; therefore, this key top 1 can be manufactured at a low cost.

Also, in the present embodiment, the normal ink 4 is printed on the key top body 2 along with the transparent fluorescent ink 3. Thus, when the key top 1 is used under normal conditions (when it is not used in the dark), the user recognizes the cognitive mark printed on the key top body 2 with the non-fluorescent normal ink 4. On the other hand, when the key top 1 is used in the dark, the user recognizes the key top body 2 by the light emitted from the transparent fluorescent ink 3 containing the fluorescent material.

As mentioned earlier, the transparent fluorescent ink 3 is light-colored and not visually perceptible unless irradiated by the black light lamp 6A. Thus, by implementing the transparent fluorescent ink 3 that emits light upon being irradiated by the black light lamp 6A together with the non-fluorescent normal ink 4 on the key top body 2, the operability of the key top 1 can be maintained regardless of its environment (brightness).

Further, as mentioned earlier, in the present embodiment, the transparent fluorescent ink 3 is layered on top of the normal ink 4 rather than being printed separately on the key top body 2. In this way, the key top size can be reduced.

Next, a description of an electronic apparatus in which the above-described key top 1 and key top lighting device are implemented is given. In the following, a portable terminal apparatus (i.e. a lap top PC) is described as an example of the electronic apparatus of the present invention.

Figure 3:
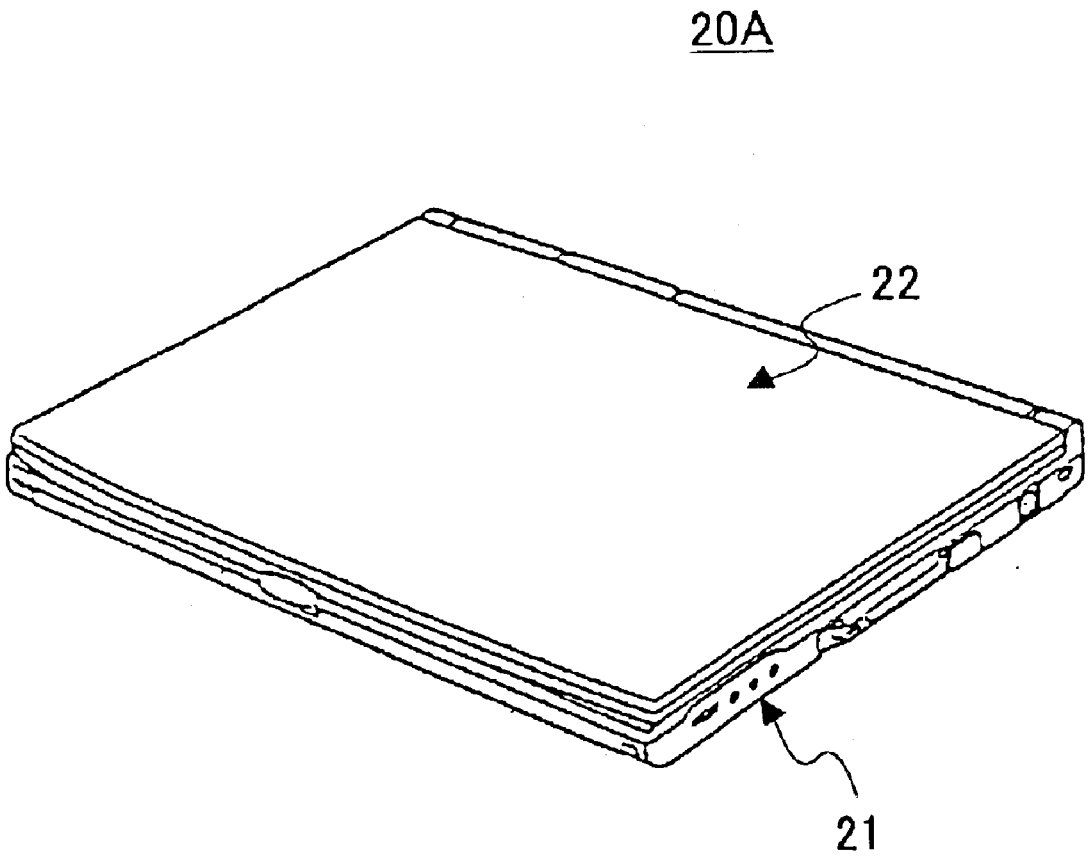
FIG. 3 is a diagram of a portable terminal apparatus that corresponds to an electronic apparatus according to the first embodiment of the present invention (with the lid structure in a closed state)

FIGS. 2 and 3 show the portable terminal apparatus 20A according to a first embodiment of the present invention.

The portable terminal apparatus 20A is essentially composed of a main body 21 and a lid structure 22. The main body 21 accommodates the key board 23 as well as other electronic devices and control devices. The lid structure 22 is rotatably attached to the main body 21 so as to be able to be opened and closed. FIG. 2 shows the lid structure 22 in an opened state, and FIG. 3 shows the lid structure 22 in a closed state.

The portable terminal apparatus 20A according to the present embodiment includes a black light lamp 6B embedded into the upper portion 25 of the lid structure 22. By implementing the black light lamp 6B at the upper portion 25 of the lid structure 22, the black light lamp 6B will be positioned above the key board 23 that is implemented in the main body 21 when the lid structure 22 is in an opened state.

Thus, the plurality of key tops making up the key board 23 can be collectively irradiated by the black light 7 so as to emit visible light. In this way, the light emitting element does not have to be implemented in each key top 1 individually as in the conventional art, thereby reducing the power consumption as well as the cost of the apparatus. Also, when the lid structure 22 is in a closed state, the black light lamp 6B will be hidden. In this way, the black light 6B made of a cold cathode fluorescent lamp can be protected from being damaged when it is not being used.

Figure 4:
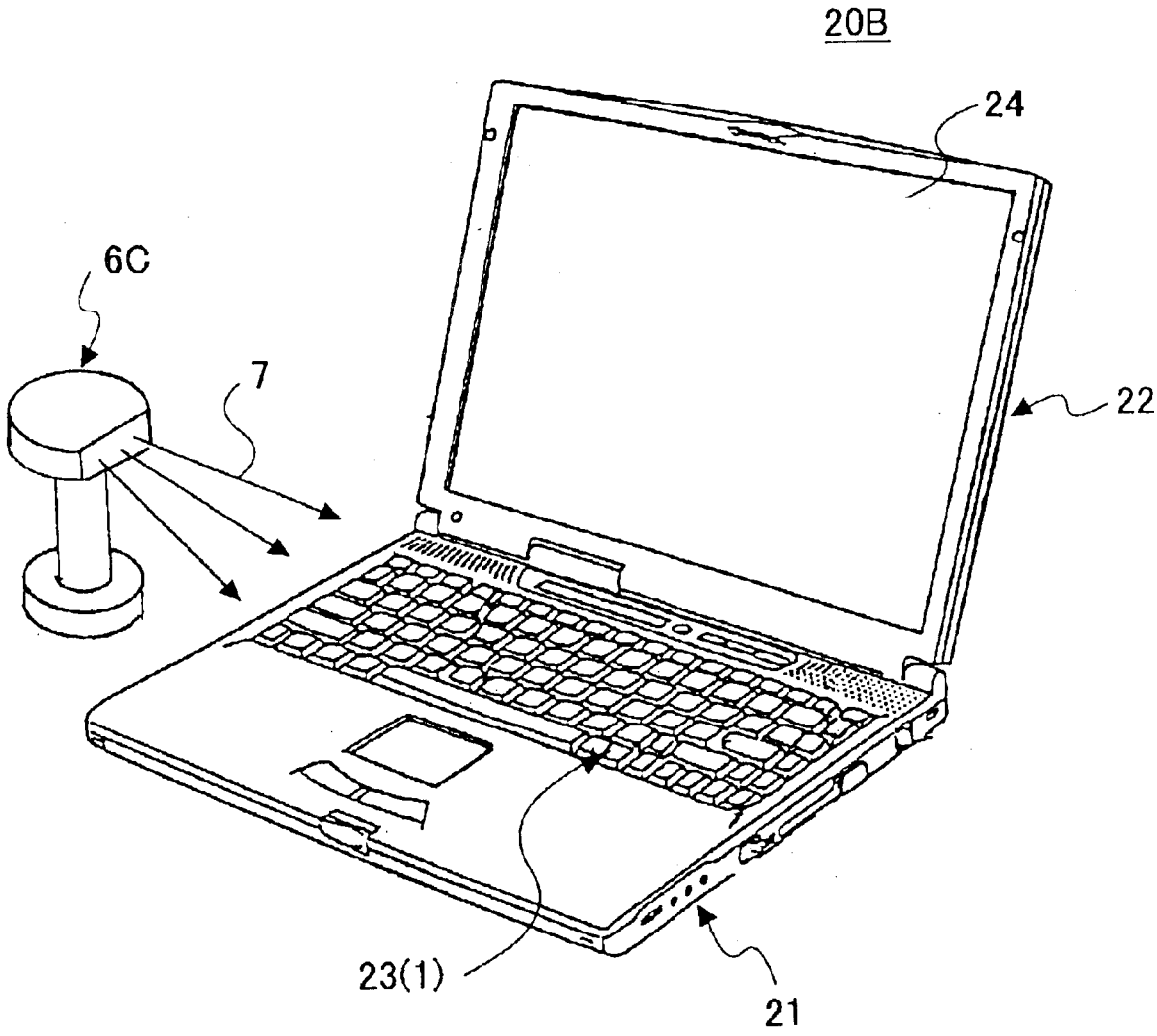
FIG. 4 is a diagram of a portable terminal apparatus that corresponds to an electronic apparatus according to a second embodiment of the present invention.

FIG. 4 shows a portable terminal apparatus 20B according to a second embodiment of the present invention. Note that in the following descriptions of FIGS. 4, 5, and 6, components that are identical to the components shown in FIGS. 2 and 3 are given the same numerical notations and their descriptions will be omitted.

In the portable terminal apparatus 20B according to the second embodiment of the present invention, a black light lamp 6C is provided separately from the main body 21 and the lid structure 22. In this configuration, the black light 6C can be placed at a position that is most suitable for the key board 23 (key top 1) to emit light.

Figure 5:
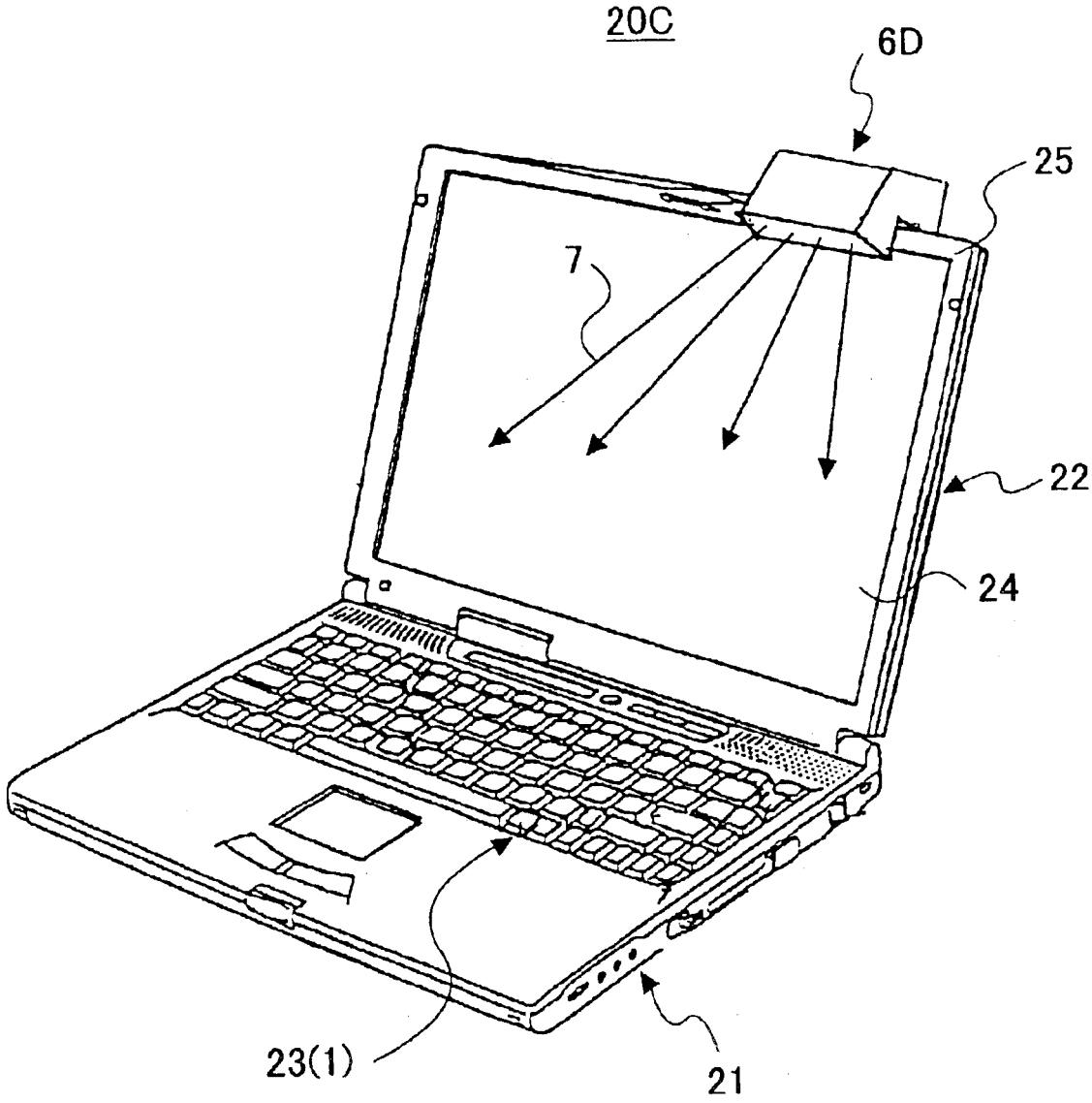
FIG. 5 is a diagram of a portable terminal apparatus that corresponds to an electronic apparatus according to a third embodiment of the present invention.

FIG. 5 shows a portable terminal apparatus 20C according to a third embodiment of the present invention. In this embodiment, a black light lamp 6D is detachably mounted onto the upper portion 25 of the lid structure 22. In this embodiment, the black light lamp 6D may be an optional accessory of the portable terminal apparatus 20C. Also, since the black light lamp 6D is fitted to the lid structure 22, the overall size of the portable terminal apparatus including the black light lamp 6D can be reduced compared to the apparatus shown in FIG. 4 wherein the black light lamp 6C is arranged outside the apparatus.

Figure 6:
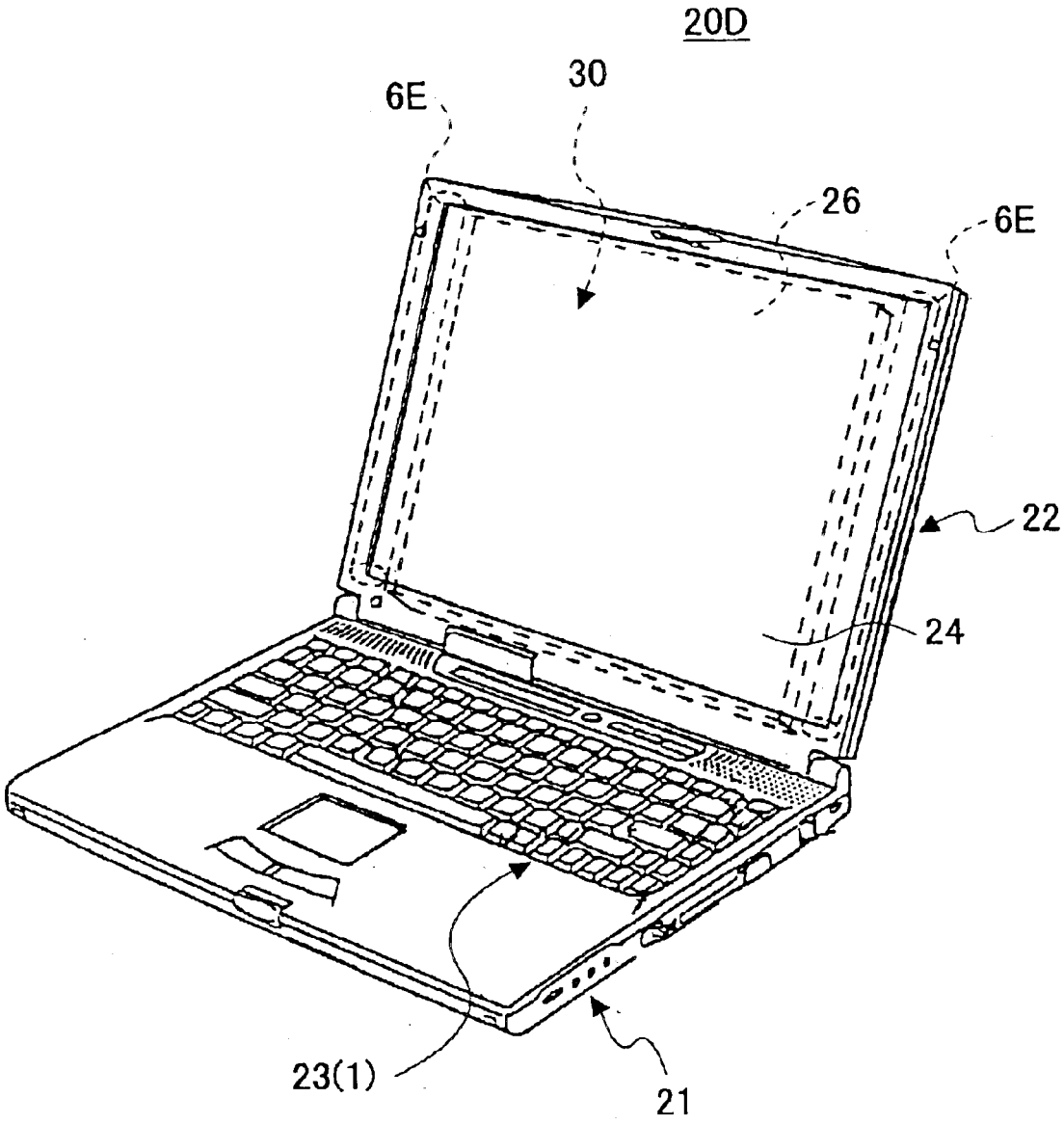
FIG. 6 is a diagram of a portable terminal apparatus that corresponds to an electronic apparatus according to a fourth embodiment of the present invention.

FIG. 6 shows a portable terminal apparatus 20D according to a fourth embodiment of the present invention. In this embodiment, a back light mechanism 30 of a liquid crystal display 24 is used as a black light lamp 6E.

Figure 7:
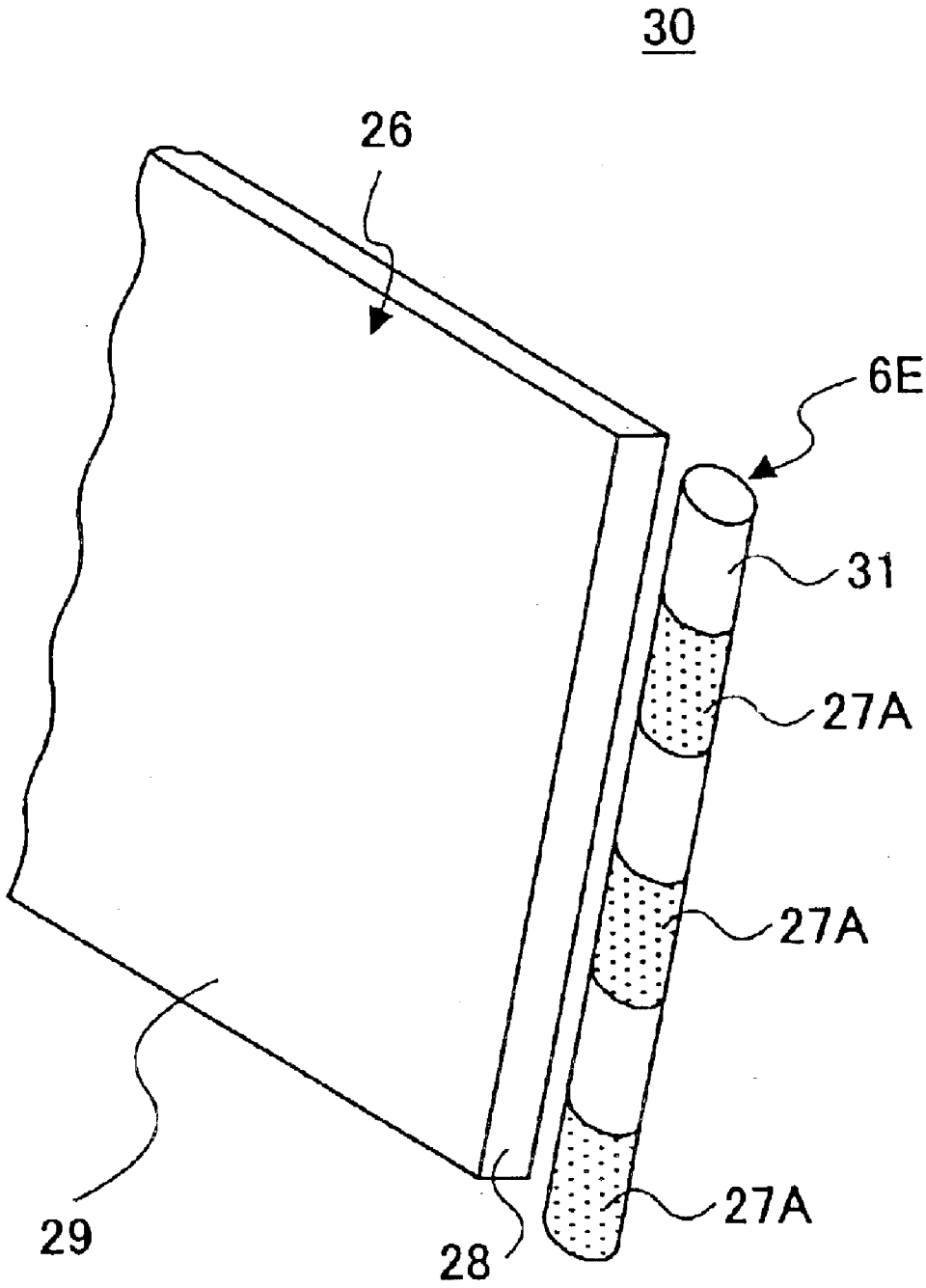
FIG. 7 is an enlarged diagram of a black light lamp implemented to the electronic apparatus according to the fourth embodiment of the present invention.

In the portable terminal apparatus 20D, the back light mechanism 30 is implemented at the back portion of the liquid crystal display 24 for displaying a sharp and bright image on the liquid crystal display 24. The back light mechanism 30 includes a light source (the black light 6E corresponds to the light source in the present embodiment) and an optical waveguide 26 as shown in FIGS. 6 and 7.

The light discharged from the light source enters the optical waveguide 26 via its side 28, is reflected at a reflection sheet (not shown) implemented at a back surface of the optical waveguide 26, and is thus emitted from a light emission surface 29 in the form of uniform light. The light emission surface 29 is arranged at the opposite side of the back surface of the liquid crystal display 24; therefore, the liquid crystal display 24 can reflect a sharp and bright image.

In this liquid crystal display 24, the brightness is lowered when the portable terminal apparatus 20D is used in the dark. However, the back light mechanism 30 of the liquid crystal display 24 will never be completely turned off.

Thus, in the present embodiment, the light source provided at the back light mechanism 30 is also used as the black light lamp 6E. Specifically, the black light lamp 6E includes a cold cathode fluorescent lamp 31, which is the light source, and a filter applied part 27A, which is intermittently arranged at the cold cathode fluorescent lamp 31 (see FIG. 7)

This filter applied part 27A has a characteristic of cutting off light, discharged from the cold cathode fluorescent lamp 31, that has a wavelength below 300 nm or above 450 nm. Also, by adjusting the length of the filter applied part 27A (in a lengthwise direction), the intensity of the black light 7 can be adjusted (in other words, the brightness of the liquid crystal display 24 can be adjusted).

According to the above configuration, the black light 7 is irradiated from the positions of the filter applied part 27A of the cold cathode fluorescent lamp 31, and unfiltered light (in which the light wavelength is not controlled) is irradiated from the positions of the cold cathode fluorescent lamp 31 without the filter applied part 27A. Tn this way, the black light lamp 6E may be used as the light source for both the black light 7 and a normal light 8, thereby further reducing the size of the portable terminal apparatus 20D.

Figure 8:
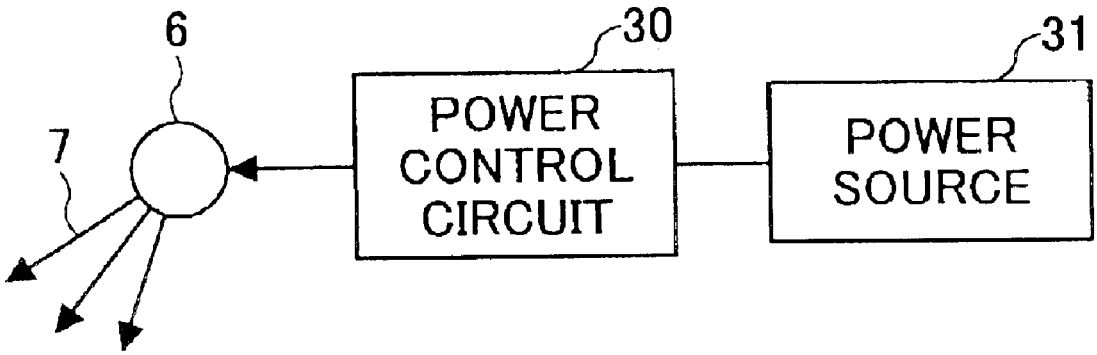
FIG. 8 is a block diagram of a power source circuit of the key top lighting device according to an embodiment of the present invention.

The above black light lamp 6 (a collective term for referring to each of the black light lamps 6A–6E) is lit by a power source 31 as shown in FIG. 8. In the configuration in which the key top lighting device is implemented in the portable terminal apparatus 20A-20D, this power source 31 will be the battery of the portable terminal apparatus 20A–20D. Also, a power control circuit 30 that controls the power supplied to the black light lamp 6 is arranged between the black light 6 and the power source 31.

Figure 9A:
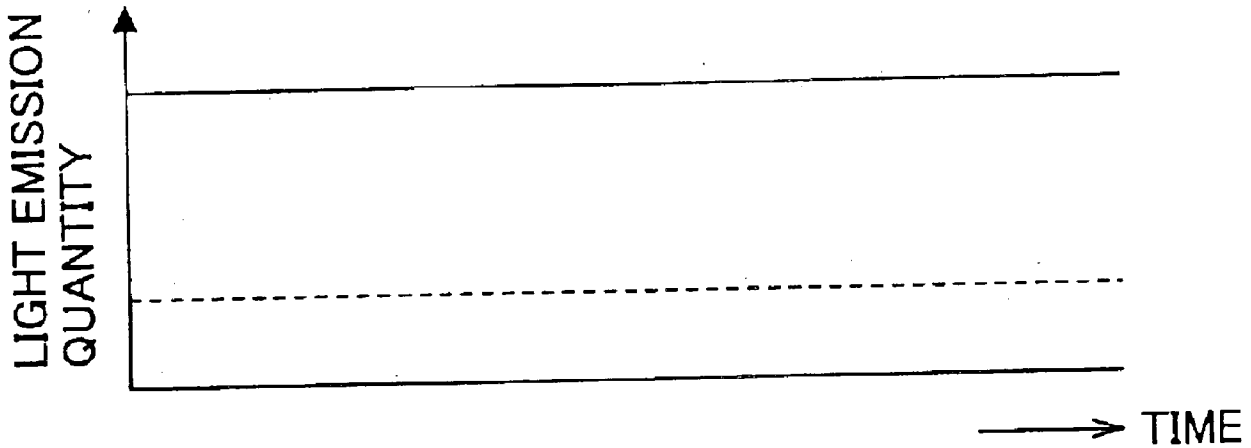
FIGS. 9A and 9B show a first example of an electric power supply control performed by a power control circuit for supplying power to the black light lamp, and the light emission quantity of the black light in this example.
Figure 9B:
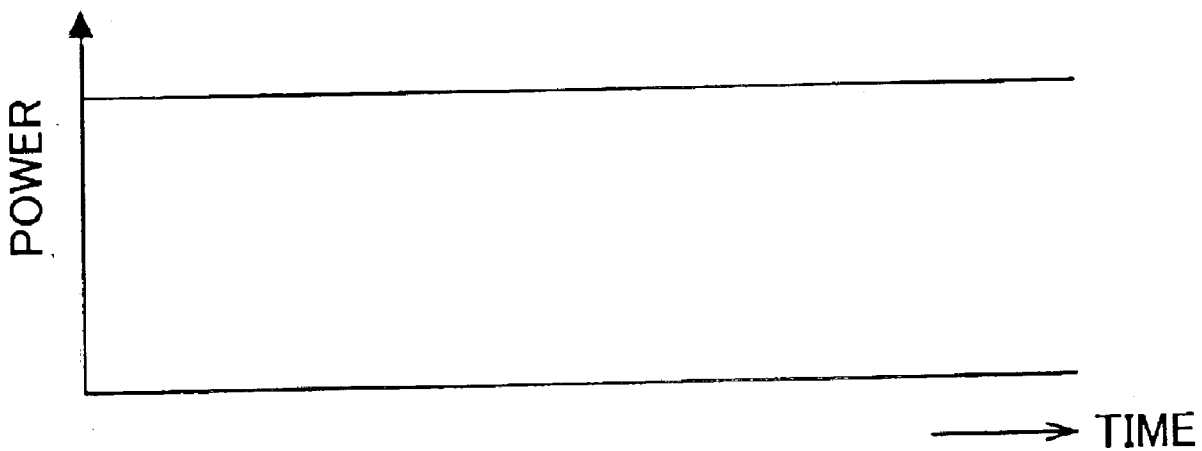

FIG. 9B shows a first example of a power supply to the black light lamp 6 controlled by the power control circuit 30. Also, FIG. 9A shows the change in the light emission quantity of the transparent fluorescent ink 3 with respect to time upon being irradiated by the black light lamp 6.

In this example, the power control circuit 30 constantly supplies a fixed level of electric power to the black light lamp 6. Accordingly, since a stable power supply to the black light lamp 6 is realized, the black light lamp 6 is able to constantly emit a fixed amount of light.

Note that the light emission quantity indicated by the dotted line in FIG. 9A is the minimum light emission quantity with which the transparent fluorescent ink 3 applied on the key top 1 can be recognized by the user of the portable terminal apparatus 20A–20D (this minimum light emission quantity being referred to as 'visibility limit light emission quantity' hereinafter). Thus, when the light emission quantity of the transparent fluorescent ink 3 goes below the light emission quantity indicated by the dotted line, the user will be unable to operate the key top 1 (key board 23).

According to this example, the light emission quantity of the transparent fluorescent ink 3 is kept at a high level as shown in FIG. 9A so as to maintain its brightness. Therefore, the key top 1 (key board 23) will have good operability, enabling the user to operate the key top 1 (key board 23) under preferable conditions. However, in the present embodiment, a fixed level of power is constantly supplied to the black light lamp 6 which results in an increase in power consumption. Specifically, when a cold cathode type fluorescent lamp is used as the black light lamp 6, an electric power level of 0.5–2.0 W is used. Thus, when the battery of the portable terminal apparatus 20A–20D is used as the power source 31 of the key top lighting device 10, the operable time period of the portable terminal apparatus 20A–20D will be reduced.

FIGS. 10–13 show various examples of the power supplying mechanism of the key top lighting device, in each of which various measures are taken to reduce the power consumption of the power source 31. As in FIGS. 9A and 9B, FIGS. 10A, 11A, 12A, and 13A show the light emission quantity of the black light lamp 6, and FIGS. 10B, 11B, 12B, and 13B show the electric power level of the electric power supplied to the black light lamp 6 from the power control circuit 30.

Figures 10A, 10B:
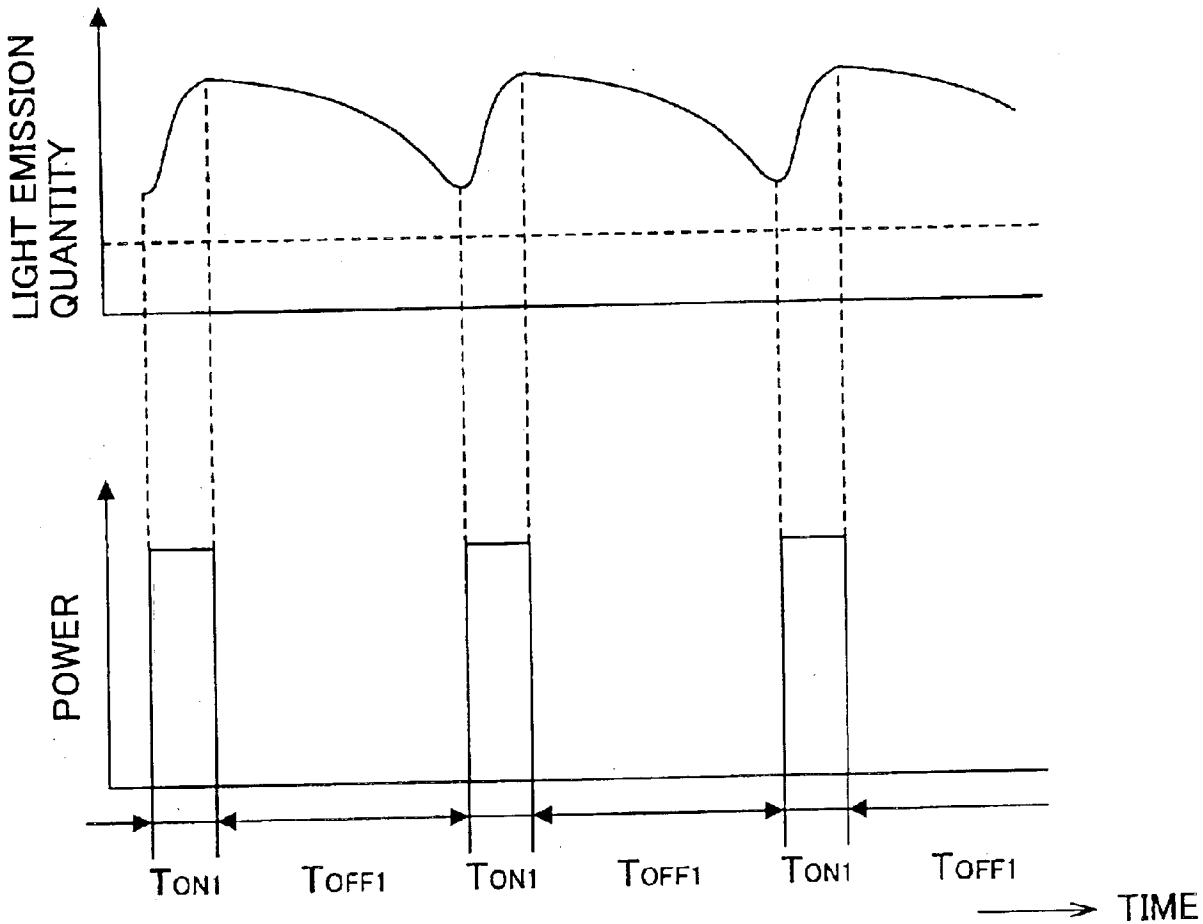
FIGS. 10A and 10B show a second example of an electric power supply control performed by a power control circuit for supplying power to the black light lamp, and the light emission quantity of the black light in this example.

FIG. 10B shows a second example of a power supply level to the black light lamp 6 controlled by the power control circuit 30. Also, FIG. 10A shows the change in the light emission quantity of the transparent fluorescent ink 3 with respect to time upon being irradiated by the black light 6.

In this embodiment, the power control circuit 30 supplies power to the black light lamp 6 intermittently. Specifically, the power control circuit 30 supplies power to the black light lamp 6 for the duration of time $T_{ON1}$, and stops the power supply during time $T_{OFF1}$, this being repetitively performed. In turn, the black light lamp 6 repeats the act of turning on the light for the duration of time $T_{ON1}$, and then turning off the light during time $T_{OFF1}$.

By intermittently turning on the black light lamp 6, the transparent fluorescent ink 3 formed on the key top 1 is intermittently irradiated by the black light 7. Consequently, the transparent fluorescent ink 3 stores the energy of the black light 7 while it is being irradiated.

As shown in FIG. 10A, the light emission quantity of the transparent fluorescent ink 3 is at its maximum at the end of the irradiation of the black light 7 and then from here, light emission quantity gradually decreases with the elapse of time. However, the power supply off time $T_{OFF1}$, during which the power supply is turned off is arranged so that the light emission quantity of the transparent fluorescent ink 3 does not go below the visibility limit light emission quantity indicated by the dotted line in FIG. 10A.

According to this example wherein the power control circuit 30 supplies electric power to the black light lamp 6 intermittently, the power consumption can be reduced compared to the first example described in FIG. 9 wherein electric power is constantly supplied to the black light lamp 6. Specifically, if the power supply off time $T_{OFF1}$ is set to satisfy $T_{OFF1}=4\times T_{ON1}$, where $T_{ON1}$ is the power supply on time, then the electric power consumption can be reduced to one fifth (⅕) of the power used in the first example.

Figures 11A, 11B:
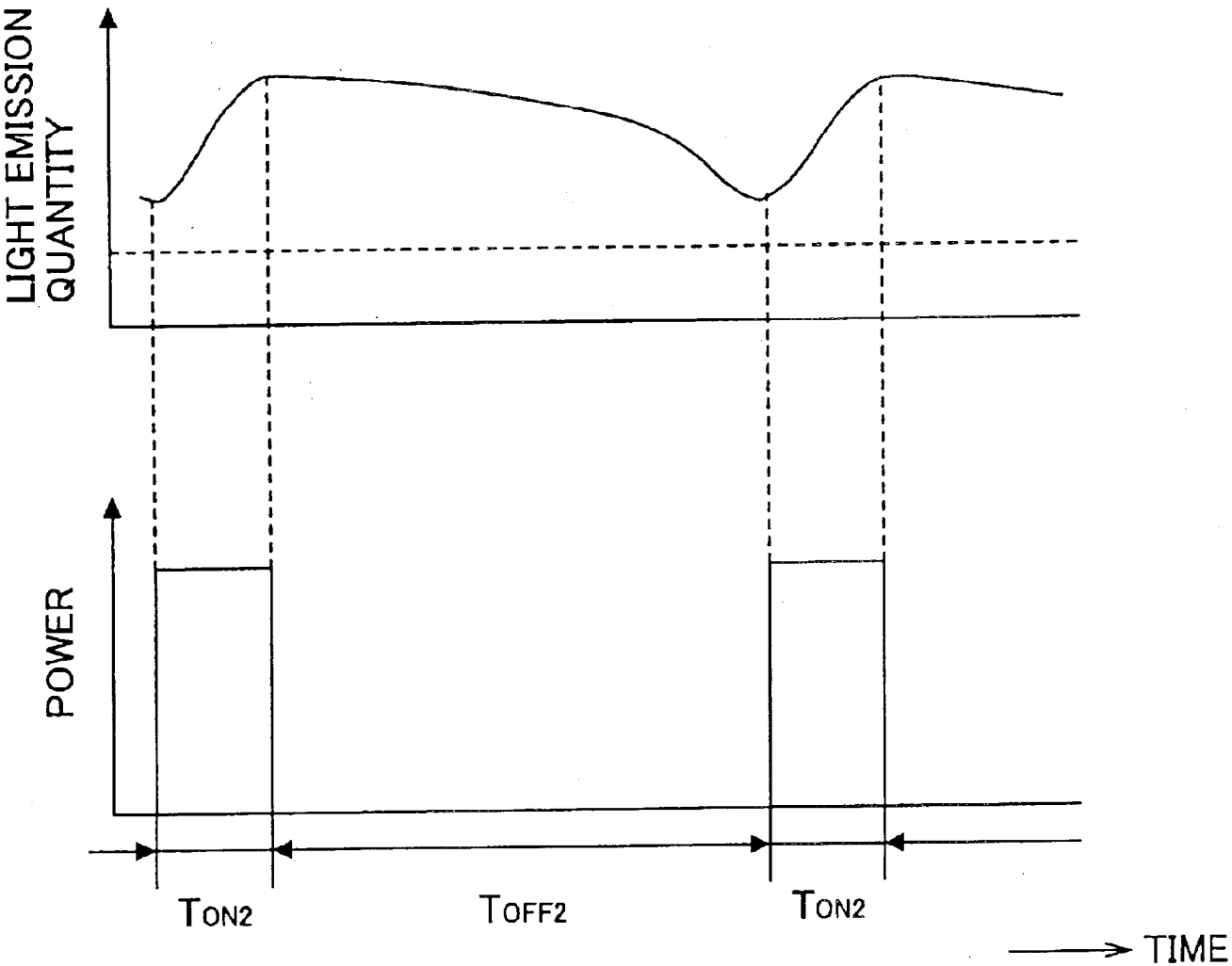
FIGS. 11A and 11B show a third example of an electric power supply control performed by a power control circuit for supplying power to the black light lamp, and the light emission quantity of the black light in this example.

FIG. 11B shows a third example of the power supply to the black light lamp 6 controlled by the power control circuit 30. Also, FIG. 11A shows the change in light emission quantity of the transparent fluorescent ink 3 with respect to time upon being irradiated by the black light lamp 6.

The power control circuit 30 supplies power to the black light lamp 6 intermittently in this example as well. However, the power supply on time $T_{ON2}$ for supplying power to the black light lamp 6 is set to be longer than the power supply on time $T_{ON1}$ of the second embodiment($T_{ON2}>T_{ON1}$).

By arranging the power supply on time $T_{ON2}$ to be longer, the energy from the black light 7 accumulated at the transparent fluorescent ink 3 increases compared to that in the second example. Thus, the light emission time of the transparent fluorescent ink 3 can be made longer, and in turn, the power supply off time $T_{OFF2}$ can be made longer.

It is known that the life of the black light lamp 6 is shortened by frequently turning it on and off numerous times. Thus, with this example, the power consumption can be reduced and the life of the black light lamp 6 can be increased at the same time.

Figures 12A, 12B:
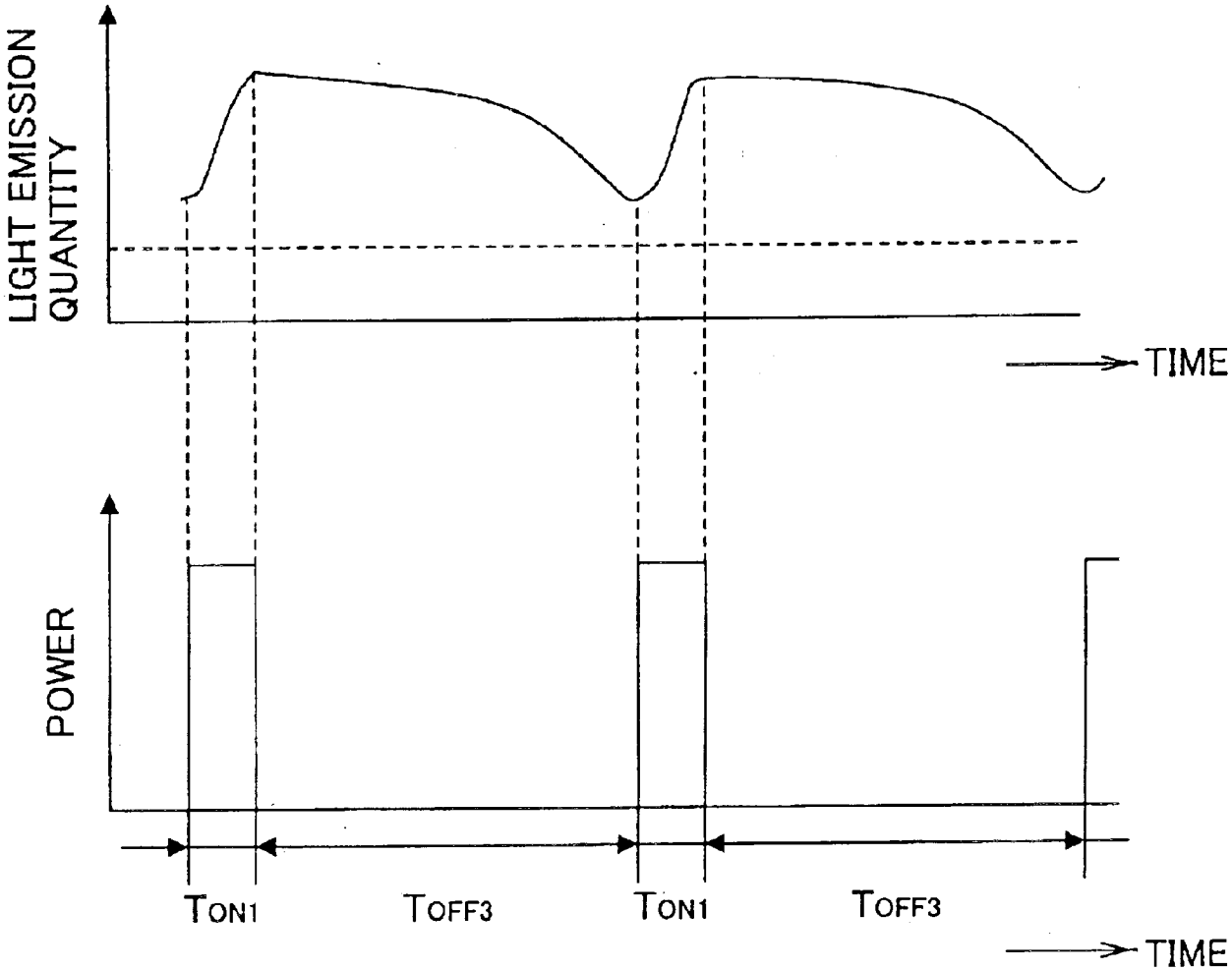
FIGS. 12A and 12B show a fourth example of an electric power supply control performed by a power control circuit for supplying power to the black light lamp, and the light emission quantity of the black light in this example.

FIG. 12B shows a fourth example of the power supply controlled by the power control circuit 30 for supplying power to the black light lamp 6. Also, FIG. 12A shows the change in the light emission quantity of the transparent fluorescent ink 3 with respect to time upon being irradiated by the black light lamp 6.

In this example, the power control circuit 30 performs the exact same control on the black light lamp 6 as in the second example of FIG. 10. That is, the power control circuit 30 supplies electric power to the black light lamp 6 for the duration of time $T_{ON1}$, and then stops the power supply for the duration of time $T_{OFF1}$, this being repetitively performed.

However, in this example, the thickness of the transparent fluorescent ink 3 implemented on the key top 1 is increased compared to the other examples. That is, in the other examples, the transparent fluorescent ink 3 is printed on the key top body 2 only once. However, in this embodiment, the transparent fluorescent ink 3 is printed on the key top body 2 three times on the same spot to form three layers of the ink. In this way, the thickness of the transparent fluorescent ink 3 on the key top 1 will be three times the thickness of the other examples.

By making the transparent fluorescent ink 3 portion thicker, the energy accumulated in the transparent fluorescent ink 3 can be increased. Thus, even when the irradiation by the black light lamp 6 lasts for the same period of time as that in the second example, the energy accumulation can be performed more efficiently. Thereby, the light emission time of the transparent fluorescent ink 3 can last longer, and in turn, the power supply off time $T_{OFF2}$ can be made longer. Thus, this embodiment is also capable of reducing the power consumption as well as increasing the life of the black light lamp.

It should be noted that upon laminate printing the transparent fluorescent ink 3 according to the present example, the bottom layer of the transparent fluorescent ink 3 may be arranged to take up the largest area, wherein the area of the printed ink decreases as the layer gets higher. According to this configuration, the laminated transparent fluorescent ink 3 layers form a pyramid structure and the lower layers will not be completely covered. Therefore, efficiency can be further improved both in absorbing the ultraviolet light (black light 7) from the black light lamp and in emitting the fluorescent light.

Figures 13A, 13B:
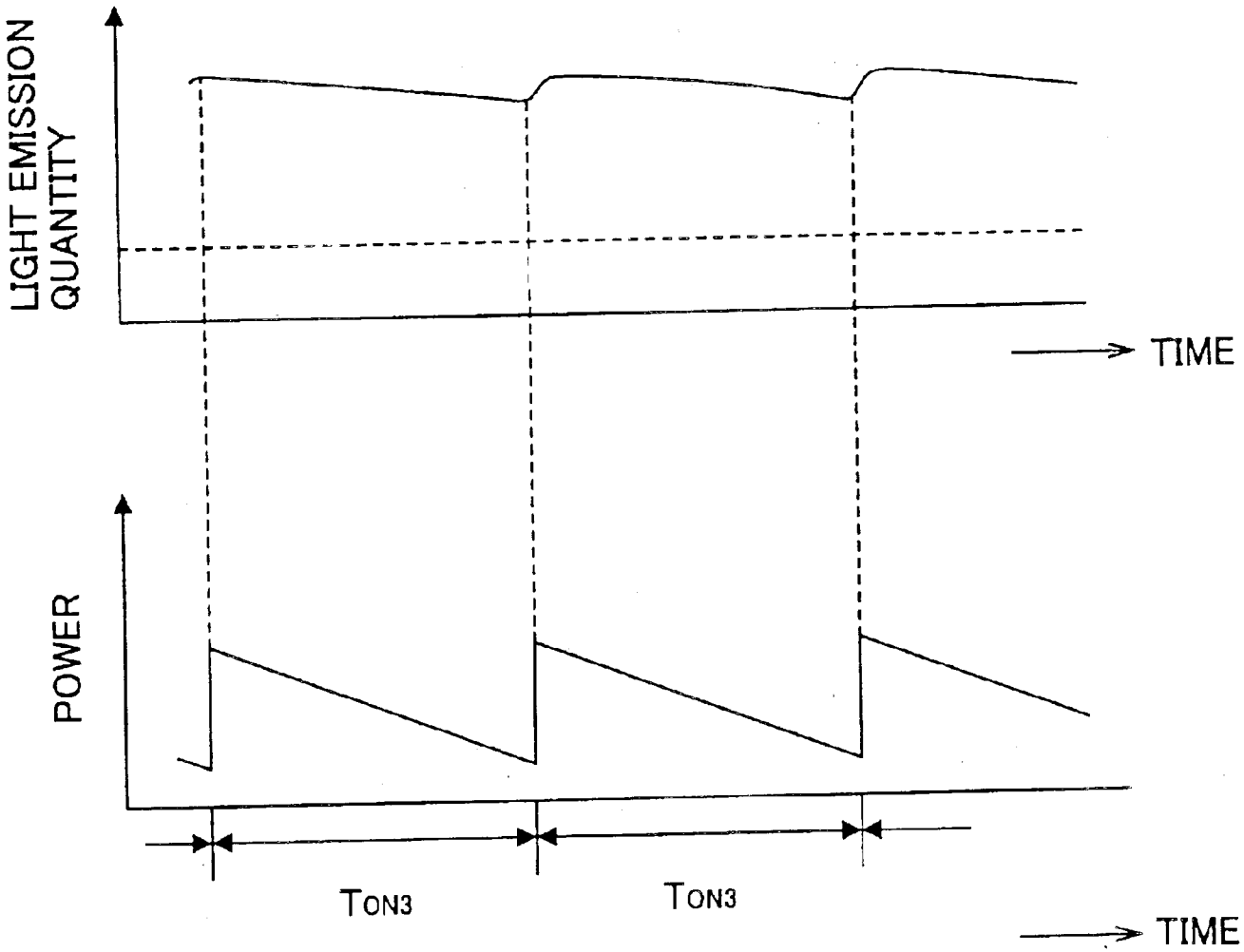
FIGS. 13A and 13B show a fifth example of an electric power supply control performed by a power control circuit for supplying power to the black light lamp, and the light emission quantity of the black light in this example.

FIG. 13B shows a fifth example of the power supply controlled by the power control circuit 30 for supplying power to the black light lamp 6. Also, FIG. 13A shows the change in the light emission quantity of the transparent fluorescent ink 3 with respect to time upon being irradiated by the black light lamp 6.

In each of the above examples of the power supplying mechanism in the lighting device according to the present invention, the power supply control is realized by performing an ON/OFF process in the power supply to the black light lamp 6 controlled by the power control circuit 30. On the other hand, in the following example, the power control circuit 30 increases and decreases the electric power level that it supplies to the black light lamp 6. That is, the power control circuit 30 supplies electric power with its level having a jagged waveform to the black light lamp 6, as shown in FIG. 13B. Herein, the power control circuit 30 increases the electric power level at the beginning of time $T_{ON3}$ and then gradually decreases the electric power level until the end of the time period, this being repetitively performed.

By increasing and decreasing the electric power level supplied to the black light 6 depending on the change in light emission quantity of the transparent fluorescent ink 3 as in this example, the light emission quantity of the transparent fluorescent ink 3 can be approximately the same at all times. The reason for this is explained in the following.

The attenuation of the light emission quantity of the transparent fluorescent ink 3 with respect to time can be obtained beforehand through experiments and the like. Also, by increasing the energy of the ultraviolet light from the black light lamp 6 irradiated onto the transparent fluorescent ink 3, in other words, by increasing the electric power level supplied to the black light lamp 6, the light emission quantity of the transparent fluorescent ink 3 can be increased.

Thus, based on the temporal attenuation of the light emission quantity of the transparent fluorescent ink 3, energy corresponding to this attenuation quantity is supplied to the transparent fluorescent ink 3 from the black light lamp 6, thereby constantly maintaining the light emission quantity of the transparent fluorescent ink 3 around the same value. In this way, the operability of the key top 1 can be improved and the power consumption can be reduced compared to the first example.

It should be noted that in each of the above examples, the lap top PC has been described as an exemplary electronic apparatus of the present invention. However, the present invention is not limited to the lap top PC; rather, it can be applied to other various electronic apparatuses that may be used in the dark.

Also, although the lighting device in FIG. 8 is not configured to directly detect the light emission quantity of the transparent fluorescent ink 3, as an alternative embodiment, a sensor that detects the light emission quantity of the light emitted from the transparent fluorescent ink 3 may be connected to the power control circuit 30 and the power control circuit 30 may be configured to control the electric power level it supplies to the black light lamp 6 based on the light emission quantity of the transparent fluorescent ink 3 obtained from this sensor.

In the following, the specific advantages of the present invention will be described.

According to a first aspect of the present invention, a predetermined light from the black light lamp is irradiated on the key top, which causes the fluorescent material on the key top to emit light, thereby enabling the key top to be recognized in the dark. In this way, a user will be able to operate the key top even in darkness. Also, in the present invention, the irradiated light from the black light is a long-wave ultraviolet light. Therefore, this irradiated light will not light up the surrounding areas and people nearby will not be disturbed by this light. Further, since the key top has a simple structure in which the fluorescent material is merely applied to the key top body, this key top can be manufactured at a low cost.

Also, a fluorescence contrast can be made on the key top body between spots on which the fluorescent material is applied and spots without the fluorescent material. In this way, a cognitive mark can be formed on the key top body. Herein the cognitive mark can be a character, a symbol, a figure, etc.

Additionally, the key top can be recognized by the cognitive mark made with the non-fluorescent ink under normal conditions (when the user operates the key top in the light), and by the cognitive mark made with the fluorescent material in the dark. Thus, the operability of the key top can be maintained regardless of the environment (brightness).

Further, by laminating the fluorescent material on top of the non-fluorescent ink, the size of the key top can be reduced compared to a configuration in which the non-fluorescent ink and the fluorescent material are separately printed onto the surface of the key top body.

According to another aspect of the present invention, the key top lighting device may be composed of a black light lamp that irradiates black light, and a key top that fluoresces upon receiving the black light from the black light lamp. In this way, the structure of the key top lighting device can be simplified and its cost can be reduced.

Also, by implementing a light emitting element and a filter member in the black light lamp, this black light lamp can be used as both the light source for inducing light emission of the fluorescent material and the light source for normal illumination.

Additionally, by changing the power supply level of the power supplied to the black light lamp, the power consumption of the device can be reduced compared to a configuration in which a fixed level of electric power is continually supplied to the black light lamp.

Further, by arranging the black light lamp at the upper portion of the lid structure, the black light will be positioned above the main body of the electronic apparatus on which the key board is implemented when the lid structure is in an opened state. Therefore, light having a predetermined wavelength can be irradiated on a plurality of key tops making up the key board all at once for inducing the light emission of the key tops.

The present application is based on Japanese priority application No. 2002-151060 filed on May 24, 2002, and Japanese priority application No. 2002-346055 filed on Nov. 28, 2002, the entire contents of which are hereby incorporated by reference.

What is claimed is:

1. A key top lighting device comprising:

a black light lamp including a light emitting element emitting light including black light, and a filter member shutting out light other than said black light emitted by said black light lamp, said filter member being intermittently arranged at said light emitting element; and a key top having a fluorescent material on a key top body, said fluorescent material emitting light when irradiated by said black light.

2. The key top as claimed in claim 1, wherein said fluorescent material is selectively arranged on said key top body.

3. The key top as claimed in claim 1, further comprising a non-fluorescent ink that is arranged on said key top along with said fluorescent material.

4. The key top as claimed in claim 3, wherein said fluorescent material is layered on top of said non-fluorescent ink.

5. The key top as claimed in 1, wherein said fluorescent material emits fluorescent light upon being irradiated by light having a wavelength within a range of 300 nm to 450 nm.

6. The key top lighting device as claimed in claim 1, comprising:

a power control part that intermittently supplies electric power to said black light lamp.

7. The key top lighting device as claimed in claim 6, which is included in electronic apparatus, in which:

said black light lamp is incorporated and a main body includes a keyboard that has a plurality of said key tops, each said key top having a key top body, and said fluorescent material arranged on said key top body.

8. The key top lighting device as claimed in claim 7, further comprising:

a lid structure that can be opened and closed to reveal and cover said main body; wherein said black light lamp is arranged at said lid structure.

9. The key top lighting device as claimed in claim 1, comprising:

a power control part that varies the electric power level supplied to said black light lamp depending on a change in the light emission quantity of said fluorescent material.

10. The key top lighting device as claimed in claim 1 comprising:

a key of a keyboard having said fluorescent material on said key top body, said lamp being attached to a lid which can be opened and closed to reveal said keyboard.

11. The key top lighting device as claimed in claim 10, wherein said lamp is detachably mounted to said lid.

12. The key top lighting device as claimed in claim 10, wherein said lamp is fixedly mounted to said lid.

13. The key top lighting device as claimed in claim 12, wherein said lid includes a liquid crystal display for displaying an image, a back light mechanism mounted at a back portion of said liquid crystal display, said back light mechanism includes an optical waveguide transmitting. and reflecting said black light onto said key top.

14. The key top lighting device as claimed in claim 10 wherein said filter member filters out light having a wavelength below 300 nm or above 450 nm and filters intensity of said black light by adjusting a length of said filter member.

15. The key top lighting device as claimed in claim 10 further comprising a power control circuit controlling power supplied to said lamp.

16. The key top lighting device as claimed in claim 15 wherein said power control circuit is arranged such that said lamp emits said black light intermittently.

* * * * *